United States Patent [19]

McWain

[11] Patent Number: 4,854,576

[45] Date of Patent: Aug. 8, 1989

[54] COLLAPSIBLE WEIGHT SYSTEM

[76] Inventor: Richard J. McWain, 56 W. Chapman Ave., Orange, Calif. 92668

[21] Appl. No.: 202,328

[22] Filed: Jun. 6, 1988

[51] Int. Cl.[4] ..... A63B 13/00

[52] U.S. Cl. ..... 272/123

[58] Field of Search ..... 272/116, 117, 119, 122, 272/123, 130; 222/105, 175, 215, 464; 383/3, 907

[56] References Cited

U.S. PATENT DOCUMENTS

| | | | |
|---|---|---|---|
| 325,987 | 9/1885 | Sparks . | |
| 2,780,378 | 2/1957 | Romano . | |
| 3,231,270 | 1/1966 | Winer . | |
| 3,334,899 | 8/1967 | Besko et al. | 272/122 |
| 3,781,007 | 12/1973 | Baker et al. | 272/123 |
| 4,029,312 | 6/1977 | Wright | 272/123 |
| 4,076,236 | 2/1978 | Iodel | 272/123 |
| 4,193,518 | 3/1980 | Holmes | 222/105 |
| 4,199,140 | 4/1980 | Feretti | 272/123 |
| 4,492,313 | 1/1985 | Touzani . | |
| 4,695,051 | 9/1987 | Jenison | 272/123 |

FOREIGN PATENT DOCUMENTS

| | | | |
|---|---|---|---|
| 28047 | of 1912 | United Kingdom | 272/122 |

*Primary Examiner*—Richard J. Apley
*Assistant Examiner*—Robert W. Bahr
*Attorney, Agent, or Firm*—Walter A. Hackler

[57] ABSTRACT

A collapsible weight system provides a collapsible/expandable diaphragm for containing a liquid which includes a closed hub disposed on one end thereof and an open hub disposed on another end thereof. A tubular cap is provided to seal the collapsible/expandable diaphragm while engaging both the closed hub and the open hub to provide axial support of the diaphragm. A pin locking system is provided in order to lock the tubular cap to a bar for lifting the weights. When the bar is engaged and locked with the cap, it extends therethrough providing additional strength and support for the collapsible/expandable diaphragm.

9 Claims, 2 Drawing Sheets

COLLAPSIBLE WEIGHT SYSTEM

The present invention relates to exercise equipment and more particularly relates to a collapsible weight system utilizing fewer elements which results in convenient portability and storage for the entire system.

Exercising through the use of weights has become increasingly popular as modern health-conscious attitudes among the general population continue to grow. While gymnasiums and exercise/health club facilities offering exotic arrays of exercise equipment, specifically designed for the toning of certain muscles in the body, continue to grow in popularity, weight lifting devices, such as barbells and dumbbells, are probably the most widely use of all the exercise equipment.

One reason for the popularity of the exercise/heath clubs is the fact that most people do not enjoy adequate living space to provide for exercise equipment in their own home. Even though a large number of people own weight systems, most such systems are, by nature, heavy, bulky and awkward to store when not in use.

It should be recognized that a typical barbell or dumbbell system does not include just a pair of weights with a bar for lifting them, but rather a complete set of weights in order that the user may vary the exercise weight to his preference, or in accordance to his exercise regime.

Accordingly, modern weight lifting devices must be adapted for use by persons having various exercise goals as well as body condition, weight, and size. In addition, as hereinabove mentioned, an individual is expected to constantly vary the weight of his or her exercise equipment by the interchange of typically solid iron or metal filled plastic weights. Consequently, a variety of weight sizes must be kept in a ready stand-by area for use by the weight lifter.

To solve this problem, a number of designers have developed collapsible weight systems. One such system is disclosed in U.S. Pat. No. 3,231,207 to Winer, which discloses a barbell having collapsible chambers in order that the weight of the barbell system may be continuously varied by varying the amount of water disposed in each of the water chambers.

In this system the chambers are disposed on a bar and filled with water to a preselected amount. The capacity of each of the chambers is regulated by sealing the chamber to the bar at various positions therealong, thus expanding or contracting the water chamber to limit the space available for water. While this system is in fact collapsible and made lighter for shipment by removal of water from the water chambers, it is in fact not without severe limitations. First, because a seal must be established between the water chamber and the bar, adjustment of the water chamber by its movement along the bar gives rise to the possibility of water leakage around the seal. Further, to adjust the water content of any one water chamber, the entire barbell, with both water chambers, must be placed in a position for draining each one of the chambers without spilling thereof. This can become rather inconvenient for apartment dwellers who do not have access to open areas suitable for draining the chambers.

Further, many exercise regiments require the initial exercise to begin with a lighter weight and progressively increase of the weight lifted. It is obvious that such a regime is difficult to effectively carry out with the winner barbell system. For example, after a short period of time, a warmup with a lighter weight exercise must be stopped and the collapsible chambers opened, each of them adjusted on the bar and thereafter filled with water before exercise can resume utilizing a slightly heavier weight.

While it appears desirable to provide a collapsible weight system for the convenience of many exercise advocates, it is also most desirable to provide such a system which also does not disrupt th exercise regimes currently formulated and utilized by most people in such programs. In other words, a most desirable collapsible weight system would provide a number of refillable weights which can thereafter be utilized in a manner consistent with conventional exercise techniques. The present invention fills that need.

SUMMARY OF THE INVENTION

A collapsible weight system, in accordance with the present invention, generally includes collapsible diaphragm means for containing a liquid, a closed hub disposed on one end of the collapsible diaphragm means and open hub means for enabling filling of the collapsible diaphragm with a liquid and cap means sized for passing through the open hub means and engaging the closed hub for both sealing the open hub means and for providing a rigid axial support to the collapsible diaphragm means. To facilitate the cap, the open hub means is disposed on an opposite end of the collapsible diaphragm means and in a coaxial relationship with the closed hub.

Because the cap means provides rigid axial support for the collapsible diaphragm means, it is a self-contained unit when the cap means is in a sealing relationship therewith. This is particularly true when the collapsible diaphragm means is filled with water.

More particularly, the collapsible diaphragm means is collapsible along a longitudinal access thereof and the collapsible diaphragm means closed hub and open hub means are molded together, preferably from a single piece of material.

Importantly, the cap means, in accordance with the present invention, is further operative for controlling the expansion of the collapsible diaphragm in order to control the filled weight of the collapsible diaphragm. In this manner, the cap means may include a plurality of individual caps, each having a different length, with each length defining a different amount of expansion of the collapsible diaphragm when inserted through the open hub means sealed thereto and engaging the closed hub. Hence, when each diaphragm is filled utilizing a hub of a different length, a selection of fixed weight is available for the user in the same manner that the user would select a fixed iron or metal filled plastic weight.

More specifically, the collapsible weight system, in accordance with the present invention, may include bar means for engaging the cap means in order to enable lifting of the collapsible diaphragm in a manner consistent with conventional weight lifting exercises.

The cap means may comprise a tubular body having an open end thereon to enable the bar to be inserted therein along substantially the entire length thereof. In this manner, the bar provides additional rigidity to the cap means in its axial support of the collapsible diaphragm.

Means are provided for temporary locking the bar means to the cap means in order that the separation of the collapsible weight does not occur during exercise.

BRIEF DESCRIPTION OF THE DRAWINGS

The advantages and features of the present invention will appear from the following description when considered in conjunction with the accompanying drawings in which.

DETAILED DESCRIPTION

Figure 1:
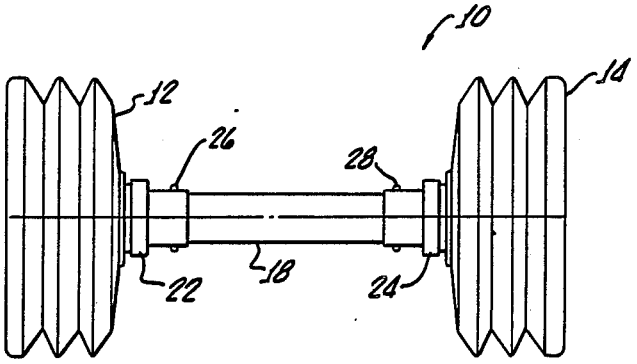
FIG. 1 is a front view of a collapsible weight system, in accordance with the present invention, generally showing a pair of collapsible diaphragms interconnected by a bar.

Turning now to FIG. 1, there is shown a collapsible weight system 10, in accordance with the present invention, generally showing a collapsible diaphragms 12, 14, disposed on a bar 18 and locked thereto by means of caps 22, 24. Locking pins 26, 28, respectively, lock the caps 22, 24 to the bar 18, as will be hereinafter described in greater detail.

Hereinafter, a description will be directed to one collapsible diaphragm 12, it being understood that a plurality of identical collapsible diaphragms may be provided in accordance with the present invention, each having identical configuration.

In general, the collapsible diaphragm 12 may be molded from any suitable material, such as plastic, and of sufficient flexibility to enable an accordianlike structure 32, well known in the art, which is collapsible along a longitudinal axis 34 of the collapsible diaphragm means.

A closed hub 40 is disposed and preferably molded as part of the collapsible diaphragm on one end 42 thereof.

Disposed on an opposite end 44 of the collapsible diaphragm 12 and preferably molded thereinto is an open hub 46 which provides means for enabling the filling of the collapsible diaphragm 12 with a liquid, preferably water. It should be appreciated that the relatively wide opening 50 of the hub 46, as shown, approximately 20 percent of the diameter(d) of the collapsible diaphragm 12, facilitates the filling of the diaphragm 12 and further enables in-going water to easily expand the accordianlike structure 32 when the end 42 is held in a generally horizontal position for filling through the open hub 46 by means of a tap, or the like, (not shown).

This is to be distinguished from any prior art systems in which the filling of the collapsible weight is awkward because it does not allow axial filling of the collapsible weight with the accumulating weight of water therein causing continuous expansion of an accordian-like structure 32, as in the present invention.

Figure 2:
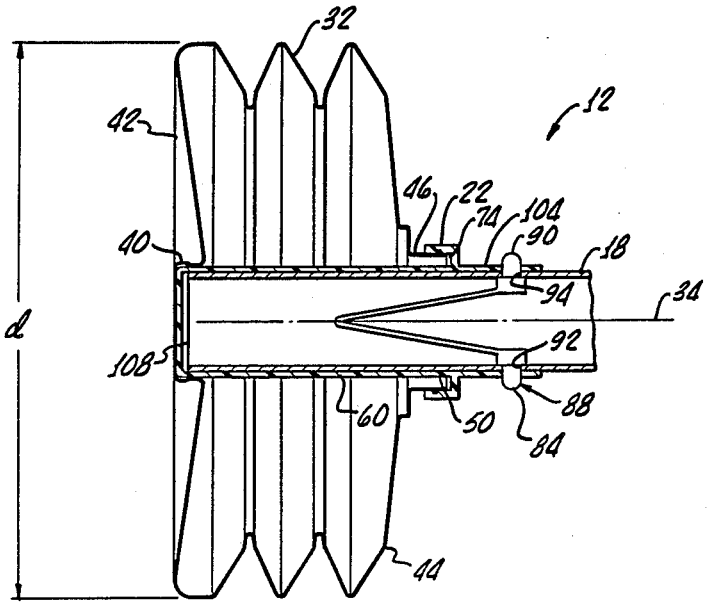
FIG. 2 is a cross-sectional view of one of the collapsible diaphragm shown in a locked position on the bar.
Figure 3:
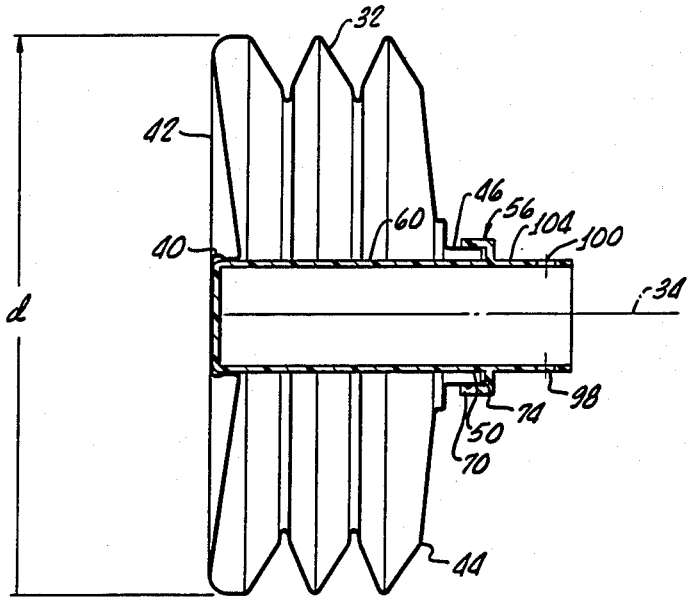
FIG. 3 is a cross-sectional sideview similar to FIG. 2 showing a filled collapsible diaphragm sealed with a cap and ready for coupling to the bar.

A tubular cap 56, which may be molded from any suitable material, such as plastic, and sized for passing through the open hub 46 is provided for both sealing the open hub 46 and for providing a rigid axial support to the collapsible diaphragm 12, the support being provided by a tubular body portion 60 of the cap which extends through the open hub 46 and engages the closed hub 40 (see FIGS. 2, 3 an 4.) The cap 56 may be secured to the open hub 46 by means of quick screw threads 64 molded into the open hub and matching grooves 66 molded into an outwardly extending berm 70 on the cap 56. An annular seal 74 may be provided to ensure watertight sealing of the diaphragm 12 via the cap 56. Alternatively, if the cap 56 is molded from a material of sufficient resiliency, pressure created between a lip 78 of the open hub 46 against a bottom 80 of the berm 70 may provide sufficient sealing.

Figure 4:
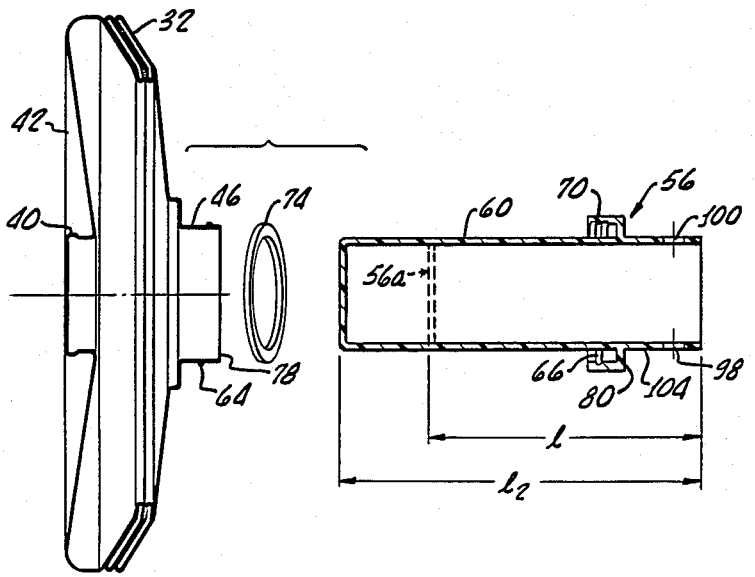
FIG. 4 is an exploded view of a collapsed diaphragm and cap, with a variation of cap length being shown in phantom line.

It should be appreciated that the tubular body 60 of the cap 56 enables the cap to be further operative for controlling the expansion of the collapsible diaphragm 12 in order to control the filled weight of the collapsible diaphragm. That is, a cap 56*a* having a different length, (1) shown in phantom line in FIG. 4, will support a filled diaphragm 12 having less weight than the cap 56, shown in solid line in FIG. 4, having a length$(1)_2$.

Accordingly, the present invention includes a plurality of caps having different lengths, with each length defining a different amount of expansion of the collapsible diaphragm when inserted through the open hub 46 sealed thereto and engaging the closed hub 40.

As hereinbefore discussed, the cap 56 coupled to the diaphragm 12 provides a "stand alone" weight which may be used interchangeably with other identical, but filled with more or less water, diaphragms, so they may be employed with the bar in a conventional manner. In order to temporarily lock the cap 56 and diaphragm 12 to the bar 18, a molded pin clip 84 may be provided having opposing pins 88 and 90 extending through holes 92, 94, and corresponding holes 98, 100 in a shank portion 104 of the cap.

FIG. 2 shows the pin clip 84 securely locking the cap 56 and diaphragm 12 to the bar 18. To release the cap 56 and diaphragm 12, the pins 88, 90 may be depressed by thumb and finger pressure so that they clear the holes in the cap shank 104, thereby enabling removal of the cap 56 and diaphragm 12 from the bar 18.

It is important to note that in caps having different lengths will naturally require a set of holes (not shown), appropriately spaced from an end 108 of the bar 18 so that when the cap and diaphragm are locked to the bar 18, the bar end 108 engages the closed hub 40, thereby enabling the bar 18 to substantially increase the axial rigidity of the filled diaphragm 12.

Although there has been described hereinabove a specific collapsible weight system, in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A collapsible weight system comprising:

collapsible diaphragm means for containing a liquid;

a closed hub disposed on an end of said collapsible diaphragm means;

open hub means for enabling filing of said collapsible diaphragm with a liquid, said open hub means being disposed on an opposite end of the collapsible diaphragm means and in a coaxial relationship with said closed hub; and cap means, sized for passing through said open hub means and engaging said closed hub, for both sealing said open hub means and for providing a rigid axial support to said collapsible diaphragm means;

said cap means being further operative for controlling the expansion of the collapsible diaphragm in order to control the filled weight of the collapsible diaphragm, said cap means comprising a plurality of caps having different lengths, each length defining a different amount of expansion of the collapsible diaphragm when inserted through the open hub means, sealed thereto and engaging said closed hub.

2. A collapsible weight system comprising:

collapsible diaphragm means for containing a liquid;

a closed hub disposed on one end of said collapsible diaphragm means;

open hub means for enabling filling of said collapsible diaphragm with a liquid, said open hub means being disposed on an opposite end of the collapsible diaphragm means and in a coaxial relationship with said closed hub;

cap means, sized for passing through said open hub means and engaging said closed hub, for both sealing said open hub means and for providing a rigid axial support to said collapsible diaphragm means, said cap means comprising a tubular body open on one end thereof of enable a bar to be inserted therein along substantially the entire length thereof;

bar means sized for insertion into said cap means, for providing additional rigidity to the cap means and to enable lifting of said collapsible diaphragm in a manner consistent with conventional weight lifting exercises, and means for temporarily locking said bar means to said cap means.

3. The collapsible weight system according to claim 2 wherein said collapsible diaphragm means is collapsible along a longitudinal axis thereof.

4. The collapsible weight system according to claim 6 wherein said collapsible diaphragm means, closed hub, and open hub means are molded together.

5. The collapsible weight system according to claim 4 wherein the means for temporarily locking said bar means to said cap means comprises a retractable pin disposed in said bar sized for engaging openings in said cap means.

6. A collapsible weight system comprising:

collapsible diaphragm means for containing a liquid;

a closed hub disposed on one side of said collapsible diaphragm means;

open hub means for enabling filling of said collapsible diaphragm with a liquid, said open hub means being disposed on an opposite end of the collapsible diaphragm means and in a coaxial relationship with said closed hub;

cap means for sealing said open hub means and for controlling the expansion of the collapsible diaphragm in order to control the filled weight of the collapsible diaphragm, said cap means comprising a plurality of caps having different lengths and each sized for passing through said open hub means and engaging said closed hub;

bar means for engaging a cap in order to enable lifting of said collapsible diaphragm in a manner consistent with conventional weight lifting exercise; and means for temporarily locking said bar means to a cap sealing the open hub means.

7. The collapsible weight system according to claim 6 wherein said collapsible diaphragm means comprises a plurality of collapsible diaphragms, each sealable by one of the caps and interchangeable on said bar means when filled with water and sealed by a cap.

8. The collapsible weight system according to claim 7 where each collapsible diaphragm is collapsible along a longitudinal axis thereof.

9. The collapsible weight system according to claim 8 where each collapsible diaphragm has a closed hub and an open hub means molded thereinto.

* * * * *